US005751209A

United States Patent [19]

Werner et al.

[11] Patent Number: 5,751,209

[45] Date of Patent: May 12, 1998

[54] SYSTEM FOR THE EARLY DETECTION OF FIRES

[75] Inventors: Jürg Werner, Zwillikon; Max Schlegel, Männedorf, both of Switzerland

[73] Assignee: Cerberus AG, Mannedorf, Switzerland

[21] Appl. No.: 345,735

[22] Filed: Nov. 20, 1994

[30] Foreign Application Priority Data

Nov. 22, 1993 [CH] Switzerland ..... 3 479/93-0

[51] Int. Cl.[6] ..... G08B 1/00

[52] U.S. Cl. ..... 340/286.05; 340/517; 340/522; 340/693

[58] Field of Search ..... 340/286.05, 622, 340/517, 521, 523, 693

[56] References Cited

U.S. PATENT DOCUMENTS

| | | | |
|---|---|---|---|
| 3,099,825 | 7/1963 | Harriman | 340/286.05 |
| 3,703,721 | 11/1972 | Goodwater | 340/286.05 |
| 4,027,302 | 5/1977 | Healey et al. | 340/577 |
| 4,319,229 | 3/1982 | Kirkor | 340/517 |
| 4,633,230 | 12/1986 | Tam | 340/517 |
| 4,725,819 | 2/1988 | Sasaki et al. | 340/517 |
| 4,785,284 | 11/1988 | Kimura | 340/521 |
| 5,005,003 | 4/1991 | Ryser et al. | 340/587 |
| 5,146,209 | 9/1992 | Beghelli | 340/693 |
| 5,168,262 | 12/1992 | Okayama | 340/523 |

OTHER PUBLICATIONS

Nakanishi, Shinji et al, "Intelligent Fire Warning System applying Fuzzy Theory", IECON'91, 1991 International Conference on Industrial Electronics, Control and Instrumentation, Oct. 28–Nov. 1, 1994, pp. 1561–1566.

*Primary Examiner*—Jeffery Hofsass
*Assistant Examiner*—Davetta Woods
*Attorney, Agent, or Firm*—Burns, Doane, Swecker & Mathis, L.L.P.

[57] ABSTRACT

A fire detection system contains several detectors connected to a control center, some of which are fitted with at least two sensors for monitoring different fire parameters. Preferably, one sensor is a thermal sensor and another is an optical sensor. An arrangement for processing the sensor signals is located within each of the detectors. It contains a microcontroller for conditioning the sensor signals and for signal processing, with the aim of generating alarm signals. The alarm signals are obtained in a neural network.

25 Claims, 4 Drawing Sheets

SYSTEM FOR THE EARLY DETECTION OF FIRES

FIELD OF THE INVENTION

This invention concerns a system for the early detection of fires, in which a number of detectors are connected to a control center, some of which are fitted with at least two sensors for monitoring different fire parameters, and a means for processing the sensor signals.

BACKGROUND OF THE INVENTION

In the case of detectors with multiple sensors, the individual sensors monitor different parameters, such as heat, smoke, and the like. When the response characteristics of the detectors are satisfactorily matched, the false alarm rate per detection point can be appreciably reduced as a result. Furthermore, due to the redundancy connected with multiple monitoring devices, the reliability increases and this results in compensation between the weak and strong points which occur in single detectors.

It is the object of the present invention to reduce the false alarm rate per detection point and obtain the earliest possible detection capability at the same time.

SUMMARY OF THE INVENTION

This object is achieved according to the invention by an arrangement in which the means for processing the sensor signals are arranged locally in the detectors and have a microcontroller for conditioning the sensor signals and for signal processing, with the aim of generating alarm signals, which are obtained in a neural network.

In a detector arrangement according to the invention, the signal processing is thus transferred from a control center to the detectors and thereby decentralized, with the result that limitations on the communications bandwidth between the control center and detectors have no adverse effect. Moreover, the monitored length of the signals is not subject to limitations and the possibility of overloading the control center is practically eliminated. Furthermore, the high redundancy of the system has the advantage that in the event of failure or malfunction of the main processor in the control center, the detectors can trigger an alarm themselves.

The use of the neural network has the advantage that the reliability of the detector function is generally improved, in that there is a wide range of possibilities for linking the various signal signatures, that is the recognition pattern, which can be used in an optimum way in the neural network.

BRIEF DESCRIPTION OF THE DRAWINGS

The invention is explained in detail below with the aid of an embodiment illustrated in the drawings, in which.

DETAILED DESCRIPTION

Figure 1:
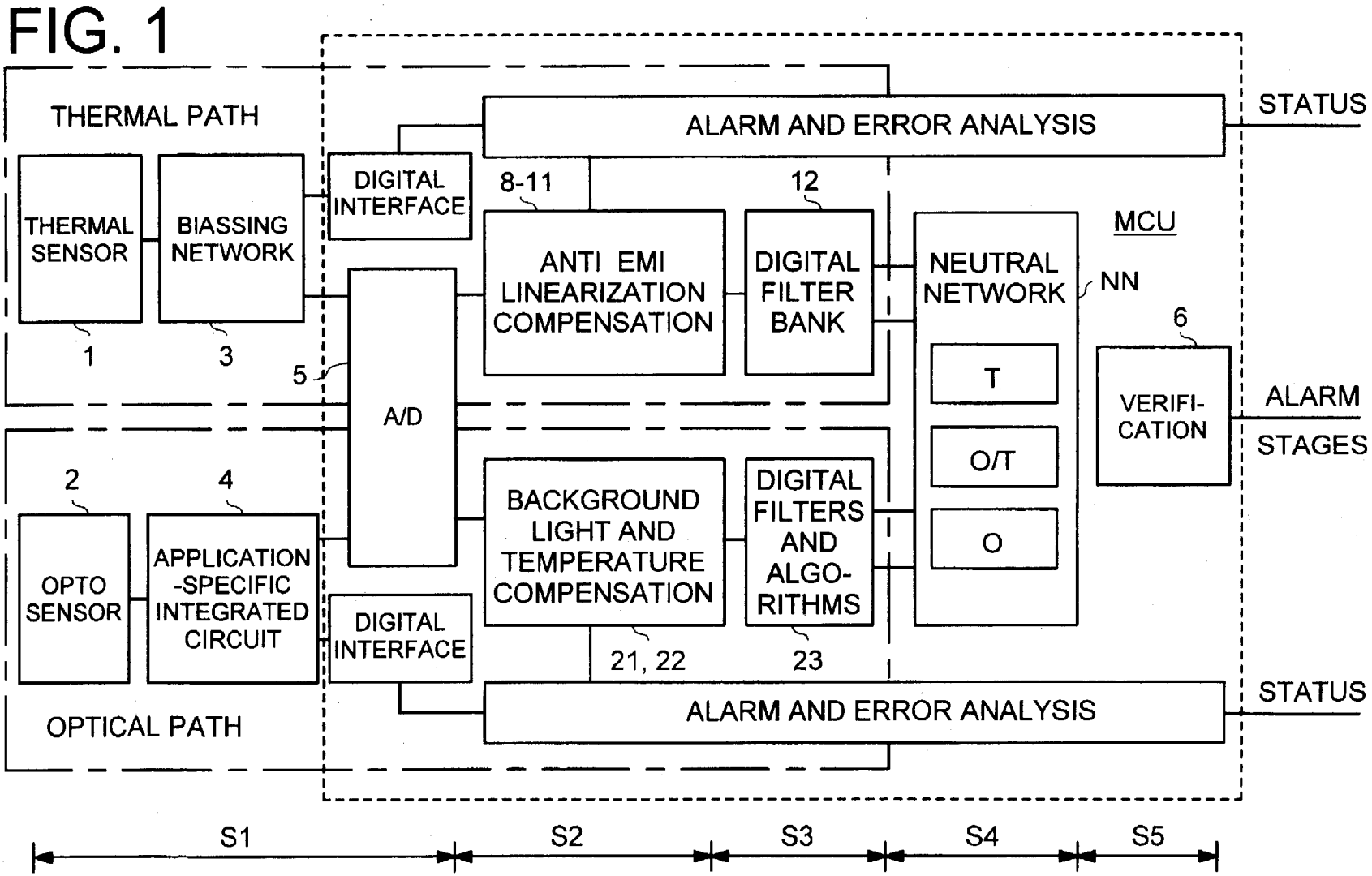
FIG. 1 is a block diagram of the signal processing in the detector.

FIG. 1 shows a block diagram of the signal processing in the detector, which can be subdivided into five stages S1 to S5. The first stage S1 consists of the sensor hardware and preferably contains a temperature sensor 1 in the form of an NTC sensor, an optical sensor 2 formed by a light pulse transmitter and a light pulse receiver, a biassing network 3 for the thermal sensor 1 and an ASIC 4. The sensor hardware also includes an A/D converter 5 which is part of a microcontroller MCU.

In a known manner the MCU has a ROM memory which contains the operating system and the sensor software of the detector and thus monitors all sequences at the functional level, i.e. the sensor control and signal processing, as well as the addressing and the communications with the control center. The ASIC 4 contains all amplifiers and filters for the signal from the light pulse receiver, a single-chip temperature sensor, the drive electronics for the light pulse transmitter, a quartz oscillator and the start-up/power management, plus the line monitoring for the MCU. Between the MCU and the ASIC 4 is a bidirectional, serial data bus and various monitor lines. The signals are conditioned in the second stage S2 following the A/D converter 5, where, by means of various compensations, an attempt is made to obtain the most accurate replica of the real measured variables, using known signal processing techniques. In the third stage S3 signal signatures or criteria are extracted, which are then condensed in the fourth stage S4 in a neural network NN to a scalar alarm signal and allocated to an alarm stage. Finally, in the fifth stage S5 a decision on a definitive alarm condition is made in a verification stage 6 and, along with the function status, is passed to the communications interface of the MCU.

Figure 2A:
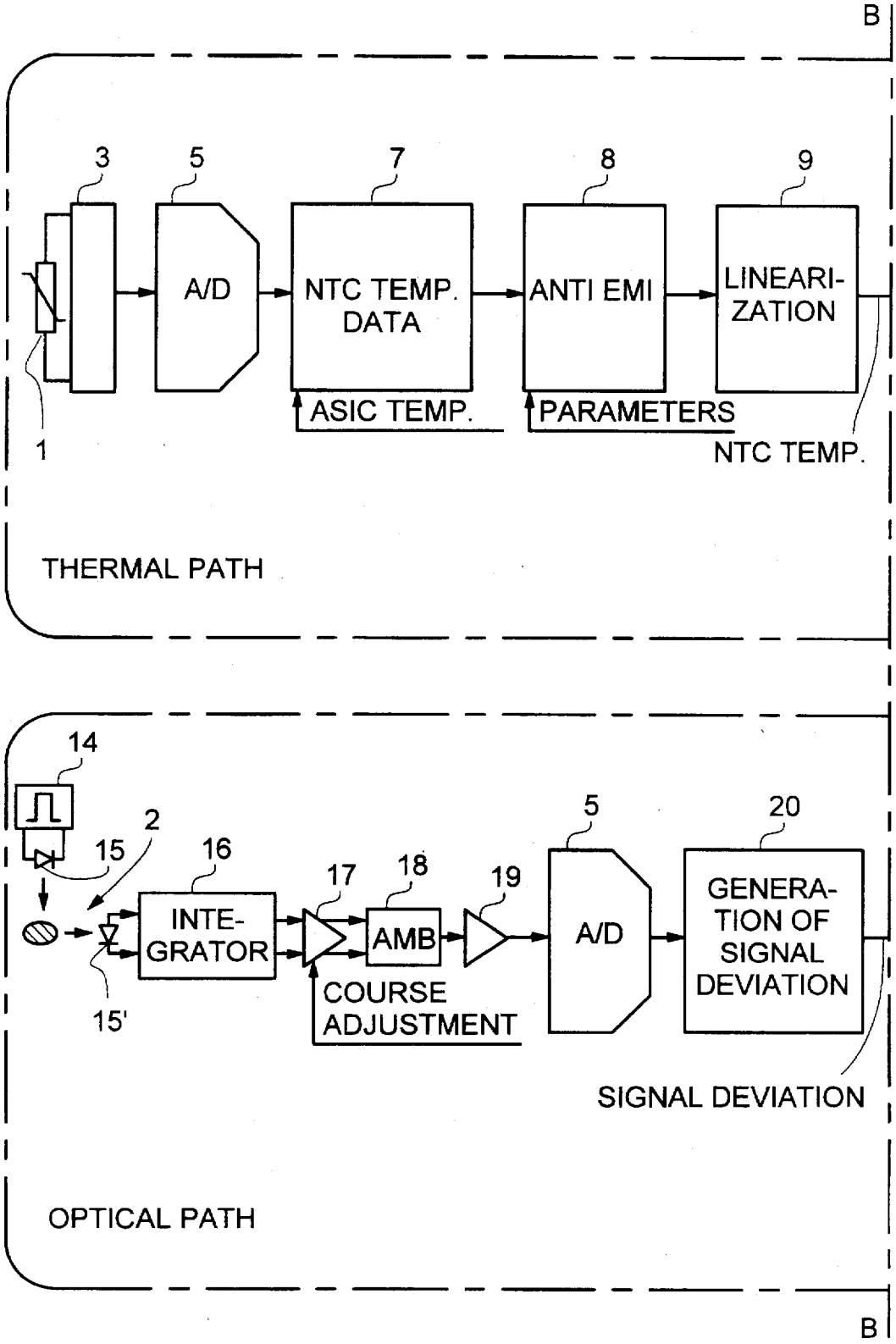
FIGS. 2*a* and 2*b* are diagrams of the two signal processing channels.
Figure 2B:
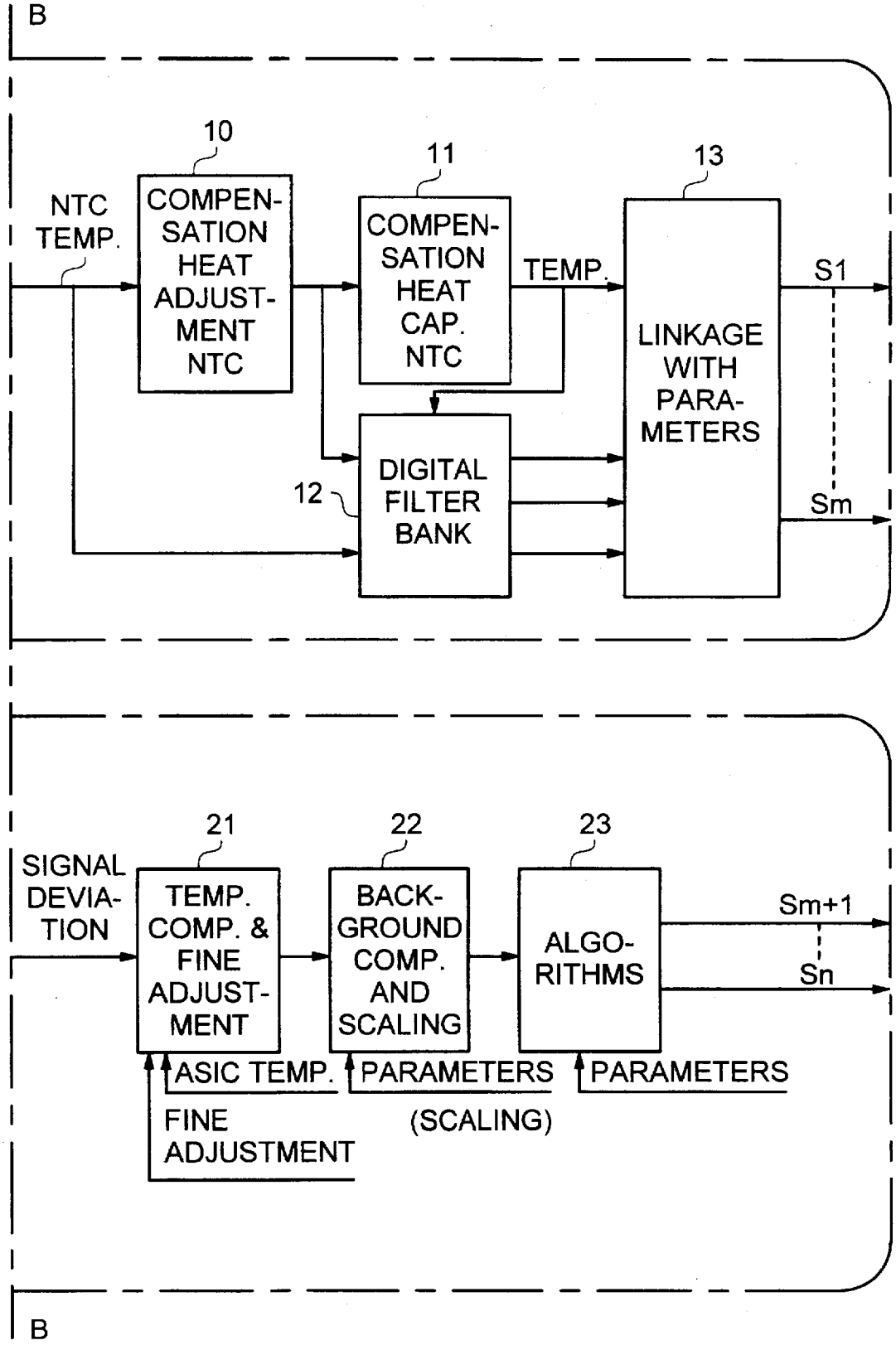
Figure 3:
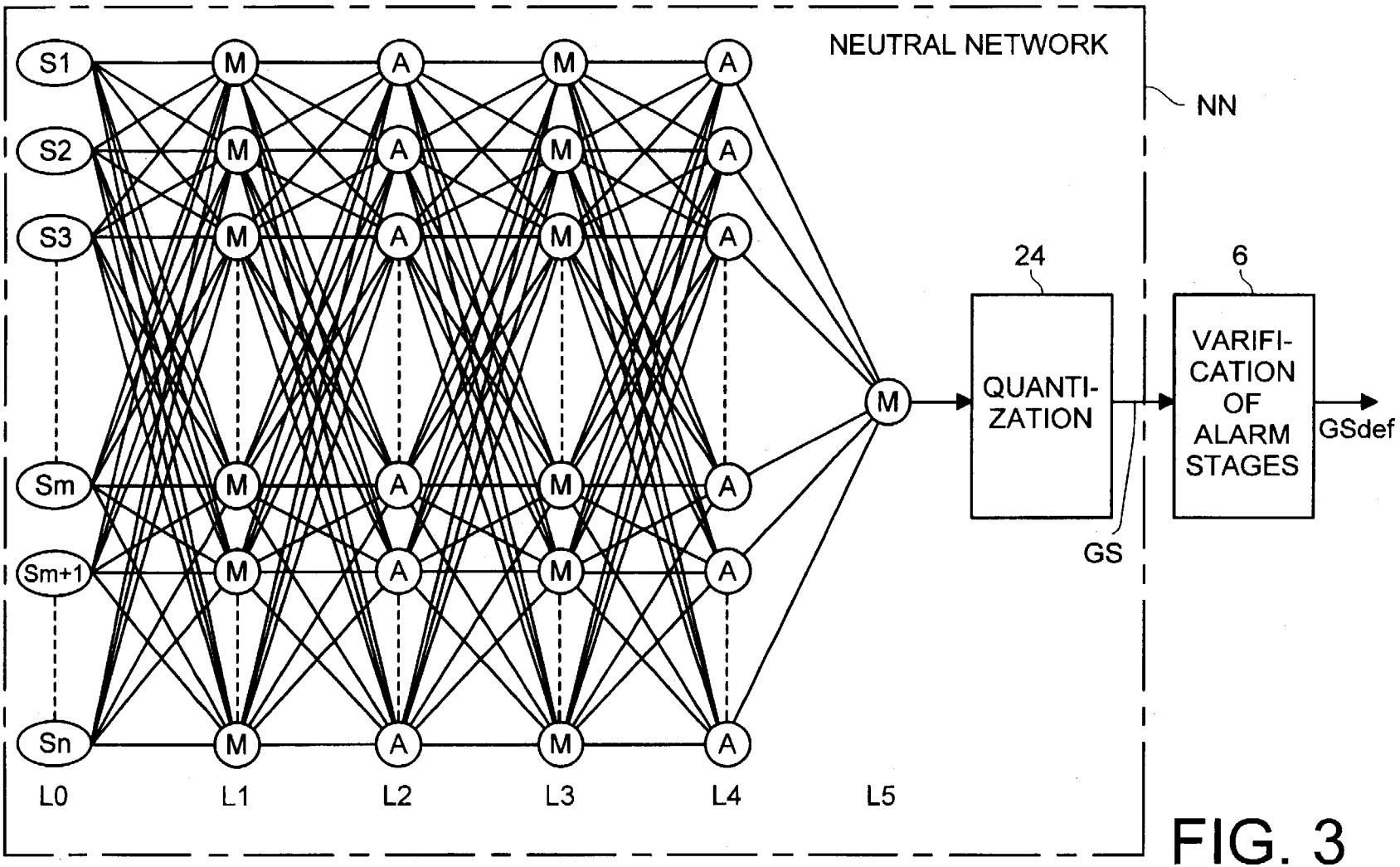
FIG. 3 is a diagram of the neural network for signal processing.

As FIG. 1 shows, the signal from the thermal sensor 1 and the signal from the optical sensor 2 pass separately through the first three stages S1 to S3, which is shown symbolically in the figure by two signal channels, a "thermal" path and an "optical" path, which are then assembled in the fourth stage S4, that is in the neural network. The signal flow of both channels through the stages S1 to S3 is shown in detail in FIGS. 2*a* and 2*b*, and the neural network NN is shown in FIG. 3.

First, the thermal signal channel and then the optical signal channel will be described. The NTC temperature sensor 1 is pulse-driven via the biassing network 3 and the NTC voltage is fed to the A/D converter 5. The NTC temperature data is then analyzed in a stage 7 where breaks and short-circuits are detected. Furthermore, to increase the measurement accuracy, in stage 7 the effect of small drive voltage changes on the measured value are compensated. Any noise, or glitches, is removed in an "anti-EMI" algorithm stage 8. This limits the signal change from one measurement to the next to specific values stored in the data memory of the MCU. Normal fire signals pass through this algorithm unchanged.

Finally, in a linearization stage 9, the output signal of the A/D converter is converted into a temperature value by means of an interpolation table dependent on the characteristics of the NTC sensor. The heat dissipation due to the connecting leads and plastic sheathing is compensated in a block 10 and the thermal capacity of the NTC sensor 1 is compensated in a block 11. The output signals of the blocks 10 and 11 then pass through a digital filter bank 12 and are linked with parameters in a stage 13.

The digital filter bank 12 preferably comprises recursive filters which operate in accordance with the general recurrence formula:

$$y(nT)=\sum_{k=0}^{M} a_k \times [(n-k)T]-\sum_{k=0}^{N} b_k y[(n-k)T]$$

where:

x(nT) is an input signal, k is a counting index, $a_k$ and $b_k$ are filter multiplication coefficients, and T is the time-lag element of a filter.

The result of this operation is to transform an input signal x(nT) into anumber of output signals y(nT). As an alternative to a recursive filter bank, it is possible to employ Fourier transforms, in which the signals are weighted according to their frequencies, or a correlator which compares the signals with stored samples.

The linking of the signals from the filter bank 12 with parameters in the stage 13 can comprise a simple arithmetic operation, in which the various signal signatures are added to or substracted from one another. As a result of these linking operations, the individual signal signatures are accepted or rejected. Several signature signals or criteria S1 to Sm, dependent on the NTC signal and thus dependent on the temperature, are therefore available at the output of stage 13 and thus at the end of the thermal path.

In the optical signal path, a pulse generator 14 that produces a more or less 100 μs long current pulse every 3 seconds drives an infra-red light-emitting diode 15 forming the light pulse transmitter, which transmits a light pulse into a visual diffusion space. The light scattered by any smoke present is collected by a lens and fed to a receiver photodiode 15'. The resulting photo current is integrated by an integrator 16 in synchronism with the transmitted pulse. A differential voltage amplifier 17 provides several optional amplification settings. This provides coarse adjustment of the detector. A so-called AMB filter 18 eliminates DC components and low-frequency interference from the signal. This filter processes the sensor signals before, during and after a light pulse from the photodiode 15, to detect the effect of the pulse on the sensor signal. High-frequency interference has already been removed by the integrator 17. A single unipolar signal that is further amplified by a voltage amplifier 19 appears at the output of the AMB filter 18.

The output signal of the amplifier 19 is converted in the A/D converter 5 into digital data, with which the software-driven signal processing starts (FIG. 1, stage S2). The effective signal deviation between a light and a dark measurement is now determined by subtraction in a stage 20. This reaches a block 21 and, due to the availability of the ASIC temperature, can be corrected at that point so that extensive compensation of the temperature outputs of the opto-electronic components takes place. The software-driven fine adjustment, which is also implemented in the block 21, is used as the final, and more or less continuous, matching of the signals to a setpoint value. In the next block 22, a correction operation removes those signal components that are caused by very slow environmental influences (for example dust accumulation), and with time would produce a false smoke signal and would therefore change the sensitivity.

The result of the previous processing steps is a variable that represents the effective, filtered, adjusted, temperature-compensated and corrected smoke value and the direct reference for determining the alarm stage. A set of digital filters controlled by various parameter sets, which assess the time characteristic of the variables representing the smoke value, are operational as the last element (block 23) in the optical signal processing. These filters operate in accordance with non-linear algorithms whose decision paths depend upon the course of the signal. In other words, the behavior of the filters change in dependence upon the signal so that undesirable phenomena, such as interference peaks, unrealistic slew rates and signal dropoff can be eliminated. Signal signatures Sm+1 to Sn are then available at the end of the optical signal processing path.

The signature signals S1 to Sn of the thermal and the optical path form the input level L0 of a layered, neural network NN, which is shown in FIG. 3. It can be seen from the representation of the neural network NN in FIG. 1 that these input variables are dependent either on the temperature signal (T), or on the optical signal (O) or both. In addition to the input level L0, the network has further levels L1 to L5 with so-called neurons or nodes. In these, the input variables, weighted with parameters, undergo an addition and a maximum and/or minimum linkage. The addition takes place in the neurons designated A and the maximum and/or minimum linkage in the neurons designated M.

Here the maximum linkage is the non-linear network function:

yi=max (w1*x1, w2* x2, . . . , wn* xn), [where xi is an input value, wi is a weighting factor, and yi is an output value] which operates according to the principle "all belong to the strongest".

The addition is the scalar product:

$$yi=\Sigma wi^* xi.$$

Basically all connections are possible between the neurons. In a learning phase during the development of the detector, the network can be incorporated in a learning environment as is well-known in neural networks. Here, due to the learning effect of the network, certain connections prove to be preferred and increase, and others atrophy, so to speak, whereby the weighting factors are adjusting accordingly. Alternatively, the network can also be designed without the learning phase. In both cases, for safety reasons the weights of the network are frozen during actual operation.

Concentration of the respective input variables, to produce a single output variable that represents a scalar alarm signal, takes place between the input and the output levels L0 to L5 of the neural network NN. The alarm signal is allocated in a quantizing stage 24 to one of several, for example, at least three alarm stages, and this signal, allocated to one of the alarm stages, is the output signal GS of the neural network NN.

Verification of the definitive alarm stage then takes place in a verification stage 6 connected downstream of the neural network. The corresponding output signal GSdef, together with the function status (FIG. 1 "status"), is communicated to the control center via the communications interface of the MCU.

Some of the particularly advantageous properties and additional functions of the described smoke alarm should be noted:

The measurement of the current ASIC temperature with the aid of a single-chip temperature sensor takes place periodically, and provides a temperature value with which the temperature response of the opto-electronic components is compensated by software, so that reliable smoke density measurements can be carried out, even at extreme temperatures.

In the signal correction stages, the smoke density signal is freed from very low-frequency components in order to filter out environmental effects which are significantly slower than fire phenomena (for, example dust accumulation). Very good long-term stability of the smoke sensitivity is thus achieved.

A regular self-test that subjects the detectors to a detailed diagnosis is carried out automatically on certain faults.

While the transfer of the signal processing from the control center to the detectors, and the use of a neural network for signal processing, is particularly advantageous for detectors with multiple sensors, it will be appreciated that the implementation of the invention is not limited to multiple-sensor systems. Naturally, detectors with only one sensor can also be constructed in the described manner. Furthermore, it should be mentioned that the neural network NN is akin to fuzzy logic and could therefore also be replaced by fuzzy logic.

A significant feature of the illustrated arrangement is constituted by the digital filter bank 12 and the block 23 (FIG. 1) in which the filter bank can comprise recursive filters. While neural networks can be used in lieu of that filter bank and/or the block 23, in which time patterns of the sensor signals are sequentially applied to the networks, such an arrangement would have two substantial disadvantages compared with the preferred embodiment:

the neural networks replacing the filter bank 12 and/or the block 23 would represent a sort of a transversal filter and would have a much smaller memory than recursive filters; and at the output of any of those neural networks there would be obtained only one signal signature per fire phenomenon (smoke, temperature), whereas the preferred embodiment makes available S1 to Sm signal signatures for the temperature phenomenon and Sm+1 to Sn signal signatures for the smoke phenomenon. This plural number of signal signatures increases the reliability of the neural network NN, which can be designed in a way that its functions are fully clear and can be readily monitored, which is indispensable in a security system.

It will be appreciated by those of ordinary skill in the art that the present invention can be embodied in other specific forms without departing from the spirit or essential characteristics thereof. The presently disclosed embodiments are considered in all respects to be illustrative and not restrictive. The scope of the invention is indicated by the appended claims rather than the foregoing description, and all changes that come within the meaning and range of equivalence thereof are intended to be embraced therein.

What is claimed is:

1. A system for the early detection of fires, comprising:

a plurality of detectors connected to a control center, wherein each of said detectors includes at least one sensor for monitoring a fire-related parameter; and a means for processing sensor signals located in each of said detectors to generate alarm signals for transmission to said control center, each of said processing means including a microcontroller for conditioning said sensor signals, signature producing means for receiving a conditioned sensor signal and generating therefrom a plurality of signature signals wherein each of said signature signals includes information regarding a shape of said conditioned sensor signal, and a neural network to which said signature signals are applied to generate said alarm signals.

2. The system of claim 1, wherein at least one of said detectors includes at least two sensors for monitoring different respective fire-related parameters, and wherein said processing means for a detector having at least two sensors comprises a separate signal processing channel for each of the sensors in the detector, and wherein signals processed in each of said channels are input to the neural network for the detector.

3. The system of claim 2 wherein each of said neural networks contains multiple levels each having nodes in which input variables are weighted, and wherein each node carries out an addition of the weighted input variables or a selection of the maximum or minimum weighted variable.

4. The system of claim 1 wherein each of said neural networks contains multiple levels each having nodes in which input variables are weighted, and wherein each node carries out an addition of the weighted input variables or a selection of the maximum or minimum weighted variable.

5. The system of claim 1 wherein the microcontroller for each processing means includes a memory storing an operating system and sensor software.

6. The system of claim 2 wherein one of said sensors is an optical sensor having a light transmitter, and wherein the signal processing channel for said optical processor includes an ASIC containing an amplifier and a filter for signals generated by the optical sensor, a temperature sensor, and drive electronics for the light transmitter in the optical sensor.

7. The system of claim 2 wherein one of said sensors is a thermal sensor, and wherein the signal processing channel for said thermal sensor includes a biassing network for said sensor, an analog-to-digital converter, a signal compensation stage, and a stage for producing signal signatures that are provided as input signals to said neural network.

8. The system of claim 7 wherein said signal compensation stage includes a voltage compensation circuit, a noise-removal circuit, a temperature conversion circuit for generating a temperature signal, and a circuit for compensating the temperature signal for heat dissipation and thermal capacity of components associated with the sensor.

9. The system of claim 8 wherein said noise-removal circuit limits changes in the sensor signal from one measurement to the next.

10. The system of claim 7 wherein said signature producing stage comprises means for linking output signals from components of said thermal sensor channel to produce multiple signature signals for input to said neural network.

11. The system of claim 6 wherein said channel for said optical sensor includes a pulse generator for driving said transmitter, an integrator for integrating signals from said sensor, an analog-to-digital converter, a signal compensation stage, and a stage for producing signal signatures that are provided as input signals to said neural network.

12. The system of claim 11 further including a voltage amplifier located downstream of said integrator in said stage for providing course adjustment of sensor signals, and a filter located downstream of said amplifier for detecting received light pulses and suppressing interference signals.

13. The system of claim 12 wherein said filter processes sensor signals before, during and after a detected light pulse.

14. The system of claim 11 wherein said signal compensation stage includes a circuit for determining effective signal deviation, a temperature compensation circuit for providing fine adjustment of the sensor signal, and a correction circuit for removing the effects of long-term environmental changes.

15. The system of claim 11 wherein said signature producing stage comprises means for filtering signals produced by said signal compensation stage to analyze their time characteristics and to thereby produce multiple signature signals for input to said neural network.

16. The system of claim 2 wherein each of said channels produces multiple signature signals related to its associated sensor, and said signature signals are combined in said neural network to produce a scaler alarm signal.

17. The system of claim 16 further including a verification stage for classifying said scaler alarm signal produced by said neural network.

18. The system of claim 1 wherein said signature producing means includes a digital filter bank for receiving a conditioned sensor signal and generating therefrom a plurality of signature signals that are provided as input signals to said neural network.

19. The system of claim 18 wherein said filter bank contains recursive filters.

20. The system of claim 18 wherein said filter bank contains means for performing Fourier transforms.

21. The system of claim 18 wherein said filter bank contains correlators.

22. A system for the early detection of fires, comprising:

a plurality of detectors connected to a control center, wherein at least some of said detectors include at least two sensors each for monitoring different respective fire-related parameters; and a means for processing sensor signals located in each of said detectors to generate alarm signals for transmission to said control center, each of said processing means including a microcontroller for conditioning said sensor signals, a digital filter bank for receiving a conditioned sensor signal and generating therefrom a plurality of signature signals wherein each of said signature signals includes information regarding a shape of said conditioned sensor signal, and a neural network to which said conditioned sensor signals and signature signals are applied to generate said alarm signals.

23. A system for the early detection of fires, comprising:

a sensor for monitoring a fire-related parameter and for producing a corresponding sensor output signal;

means for processing said sensor output signal to generate a plurality of signature signals wherein each of said signature signals includes information regarding a shape of said sensor output signal; and a neural network to which said signature signals are applied for generating an alarm signal.

24. A method for detecting fires, comprising the steps of:

measuring a fire-related parameter over time to generate a time-varying signal which is proportional to said fire-related parameter;

processing said time-varying signal to generate a plurality of signature signals wherein each of said signature signals includes information regarding a shape of said time-varying signal; and combining said signature signals in a neural network to generate a fire alarm signal.

25. A system for the early detection of fires, comprising:

a plurality of detectors connected to a control center, wherein each of said detectors includes at least one sensor for monitoring a fire-related parameter; and a means for processing sensor signals located in each of said detectors to generate alarm signals for transmission to said control center, each of said processing means including a microcontroller for conditioning said sensor signals, signature producing means for receiving a conditioned sensor signal and generating therefrom a plurality of signature signals, and a neural network to which said signature signals are applied to generate said alarm signals, wherein each of said neural networks contains multiple levels, each level having nodes in which input variables are weighted, wherein nodes in a number of said levels add weighted input variables and nodes in other of said levels select one of a maximum weighted variable and a minimum weighted variable.

* * * * *